US009145238B2

(12) United States Patent
Barreto et al.

(10) Patent No.: US 9,145,238 B2
(45) Date of Patent: Sep. 29, 2015

(54) LID FOR BEVERAGE CONTAINER AND BEVERAGE CONTAINER INCLUDING SAME

(75) Inventors: Aldo J. Barreto, Amelia, OH (US); David K. Mackenzie, Cinicinnati, OH (US); John Dugan, Lebanon, OH (US); Mark Graham, Maineville, OH (US); Bryan Keller, Springboro, OH (US); Thomas B. Remm, Milford, OH (US)

(73) Assignee: Tervis Tumbler Company, North Venice, FL (US)

( * ) Notice: Subject to any disclaimer, the term of this patent is extended or adjusted under 35 U.S.C. 154(b) by 315 days.

(21) Appl. No.: 13/491,765

(22) Filed: Jun. 8, 2012

(65) Prior Publication Data

US 2012/0312816 A1 Dec. 13, 2012

Related U.S. Application Data

(60) Provisional application No. 61/496,121, filed on Jun. 13, 2011.

(51) Int. Cl.

| | |
|---|---|
| ***B65D 51/18*** | (2006.01) |
| ***A47G 19/22*** | (2006.01) |
| ***B65D 43/12*** | (2006.01) |
| ***B65D 43/02*** | (2006.01) |
| ***B65D 47/28*** | (2006.01) |

(Continued)

(52) U.S. Cl.

CPC ..... *B65D 43/022* (2013.01); *A47G 19/2272* (2013.01); *B65D 47/286* (2013.01); *B65D 47/32* (2013.01); *B65D 81/3869* (2013.01); *B65D 2205/02* (2013.01); *B65D 2543/00046* (2013.01); *B65D 2543/00092* (2013.01); *B65D 2543/00296* (2013.01); *B65D 2543/00314* (2013.01); *B65D 2543/00518* (2013.01); *B65D 2543/00546* (2013.01); *B65D 2543/00564* (2013.01)

(58) Field of Classification Search

CPC ..... B65D 2583/0454; B65D 47/286; B65D 2543/00046; B65D 2543/00092; B65D 2543/00296; B65D 2543/00537; B65D 2543/00509; B65D 2543/00555; B65D 17/506

USPC ..... 220/812, 252, 222, 813, 780, 254.7, 220/254.9, 62.12, 592.16, 203.12, 203.17; 215/322; 3/812, 252, 222, 813, 780, 3/254.7, 254.9, 62.12, 592.16

See application file for complete search history.

(56) References Cited

U.S. PATENT DOCUMENTS

| | | | | |
|---|---|---|---|---|
| 5,199,597 | A * | 4/1993 | Gladish | 220/715 |
| 6,439,442 | B1 * | 8/2002 | Markert et al. | 222/547 |
| 7,275,653 | B2 * | 10/2007 | Tedford, Jr. | 220/254.9 |

(Continued)

*Primary Examiner* — Shawn M Braden

(74) *Attorney, Agent, or Firm* — Caesar Rivise, PC

(57) ABSTRACT

A beverage container having a slidably openable lid assembly is disclosed. The lid assembly basically comprises a base member and a cover member. The base member includes a wall portion releasably securing the lid assembly to the container and an opening in fluid communication with a beverage holding chamber in the container. The cover member is slidably coupled to the base member to slide from a closed position to an open position and vice versa. When the cover member is in the closed position it isolates the opening and the contiguous portions of the base member from the ambient surroundings. When the cover member is in the open position it exposes the opening to enable a user to drink the beverage via the opening. The cover includes an elastomeric member arranged to engage and seal the opening in the base member when the cover member is in the closed position.

20 Claims, 4 Drawing Sheets

(51) Int. Cl.
*B65D 47/32* (2006.01)
*B65D 81/38* (2006.01)

(56) References Cited

U.S. PATENT DOCUMENTS 7,874,447 B2 * 1/2011 Schmidtner et al. ..... 220/254.9
2002/0068009 A1 * 6/2002 Laudamiel-Pellet et al. ..... 422/5
2006/0081635 A1 * 4/2006 Matsutori et al. ..... 220/378
2006/0278640 A1 * 12/2006 Watts ..... 220/212
2007/0170184 A1 * 7/2007 Canedo ..... 220/254.9
2009/0057324 A1 * 3/2009 Wang Wu ..... 220/711
2009/0194535 A1 * 8/2009 Reed et al. ..... 220/254.3
2010/0200590 A1 * 8/2010 Shadrach et al. ..... 220/254.9

* cited by examiner

LID FOR BEVERAGE CONTAINER AND BEVERAGE CONTAINER INCLUDING SAME

CROSS-REFERENCE TO RELATED APPLICATIONS

This application claims priority from Provisional Application Ser. No. 61/496,121, filed on Jun. 13, 2011, entitled Lid For Beverage Container, which application is assigned to the same assignee as this application and whose disclosure is incorporated by reference herein.

FIELD OF THE INVENTION

This invention generally relates to containers and lids for containers and containers including such lids, and more particularly to slidable lids for beverage containers and beverage containers including such lids.

BACKGROUND OF THE INVENTION

Various containers for holding beverages to enable a user to drink the beverage directly from the container are available commercially. Many such containers make use a re-sealable lid to close off the access opening or spout of the container from which the user drinks the beverage. However, such prior art re-sealable beverage container/lid combinations do not optimally discourage the transfer of germs. In fact, they help spread colds, flu and other infections. In particular, the area on a container around the access opening where the user's mouth touches is not aseptic. Additionally, however, any surface area the user's mouth touched that extends beyond that area which a cap or lid may cover will likewise expose one to germs. The problem persists even when the lid or cap flips, slides or folds over the access opening. In this regard, currently available lids do not cover areas of the container where the user's lips touch.

Accordingly, a need exists for a container having a lid which is connected to the container and is movable to a position to cover all of the areas of the container which may be contacted by the user. The subject invention addresses that need.

SUMMARY OF THE INVENTION

One aspect of this invention is directed to a lid assembly for a beverage container having a beverage holding chamber defined by an interior wall. The lid assembly basically comprises a base member and a cover member. The base member includes a wall portion, e.g., a cylindrical wall having a peripheral seal, arranged to engage the interior wall of the container to releasably secure the lid assembly to the container. The base member also includes an opening in fluid communication with the beverage holding chamber when the lid assembly is releasably secured to the container. The cover member is slidably coupled to the base member, e.g., is slidably connected to the base member by means of a pair of projections of the cover member slidably received within corresponding grooves in a channel in the base member. The cover member is movable from a closed position to an open position and vice versa. The cover member is arranged when in the closed position to isolate the opening and the contiguous portions of the base member (i.e., a surrounding concave recess) from the ambient surroundings. The cover member is also arranged when in the open position to expose the opening to enable a user of the container to drink the beverage therefrom via the opening. The cover includes an elastomeric member arranged to engage and seal the opening in the base member when the cover member is in the closed position.

In accordance with one preferred exemplary embodiment of the lid assembly, the periphery of the opening includes a thickened edge arranged to be engaged by the elastomeric member to form a fluid tight seal at the opening when the cover member is in the closed position. In addition, the base member includes a vent hole and the cover member comprises a plug member arranged to close off and seal the vent hole when the cover member is in the closed position. The lid assembly additionally comprises a detent member for holding the cover member in the open position and a detent member for holding the cover member in the closed position.

In accordance with another preferred aspect of the invention there is provided a beverage container comprising a hollow vessel and a lid assembly. The hollow vessel has an interior wall defining a chamber for holding a beverage therein. The chamber has an inner wall surface. The lid assembly is constructed as set forth above and includes a base member having a wall portion arranged to engage the inner wall surface of the vessel to releasably secure the lid assembly to the container.

DETAILED DESCRIPTION OF THE PREFERRED EMBODIMENT

Figure 1:
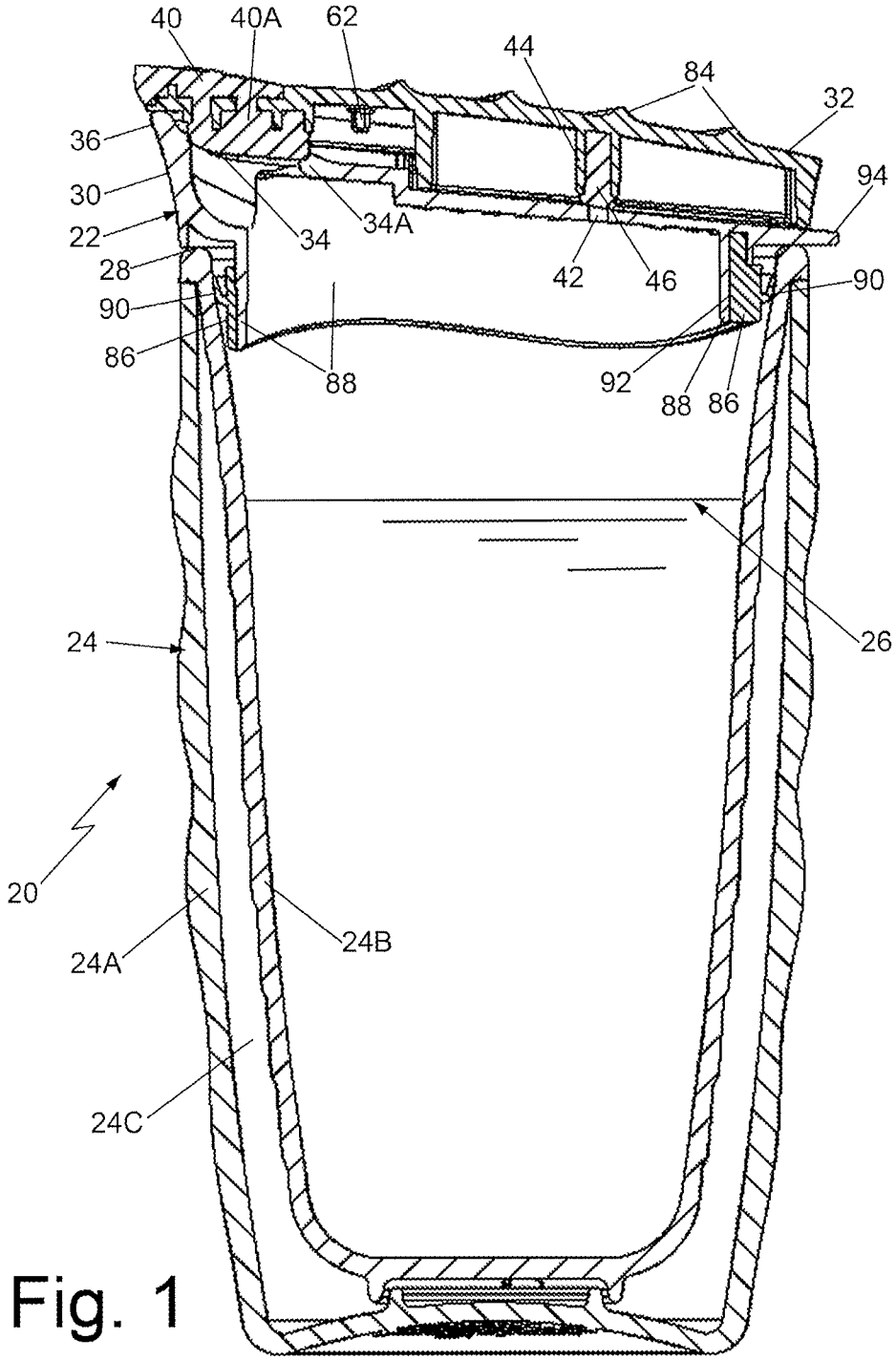
FIG. 1 is a longitudinal, vertical, cross-sectional view of a beverage container having a lid assembly constructed in accordance with one aspect this invention.

Referring now to the various figures of the drawing wherein like reference characters refer to like parts, there is shown at 20 in FIG. 1 one exemplary embodiment of a container having a lid assembly 22 which is constructed in accordance with this invention. The container 20 is merely illustrative of numerous container products that can make use of a lid assembly constructed in accordance with this invention. In particular, the exemplary container 20 is a portable, reusable, insulated beverage drinking container. That container is best seen in FIG. 1 and basically comprises is double-walled vessel, 24 having a plastic outer vessel 24A, a plastic inner vessel 24B, and an insulating air space 24C, located therebetween. The inner vessel 24B is arranged to hold a flowable beverage 26. The upper end 28 of the inner vessel 24B is open and serves as the mouth of the container. The mouth is arranged to accept (e.g., receive) a tubular portion of the lid assembly 22 (to be described later) so that the lid assembly is releasably secured to the container. When the lid assembly is removed from the container the mouth is open to enable the container's inner vessel 24B to be filled with the beverage 26.

Before describing the lid assembly 22, it should be pointed out that the container 22 shown and described herein is not the only type of container contemplated and encompassed by this invention. To that end, the subject invention is applicable to any re-sealable flowable fluid dispensing container where reducing cross contamination is desirous.

Figure 2:
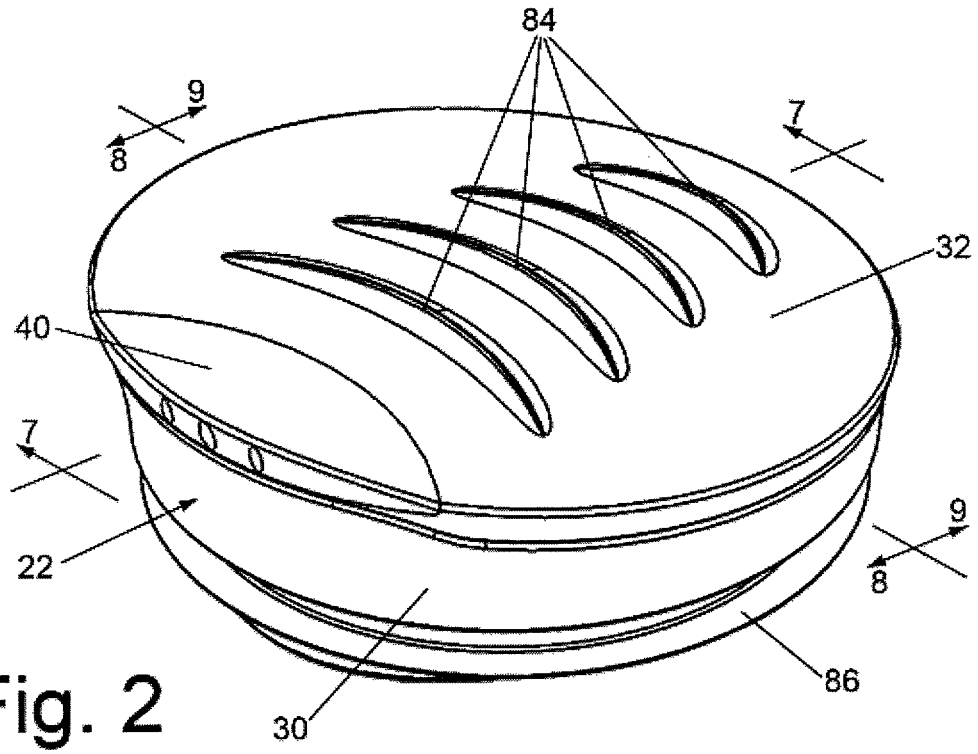
FIG. 2 is an enlarged isometric view of the lid assembly of the container shown in FIG. 1 with its cover member in the "closed" position.
Figure 3:
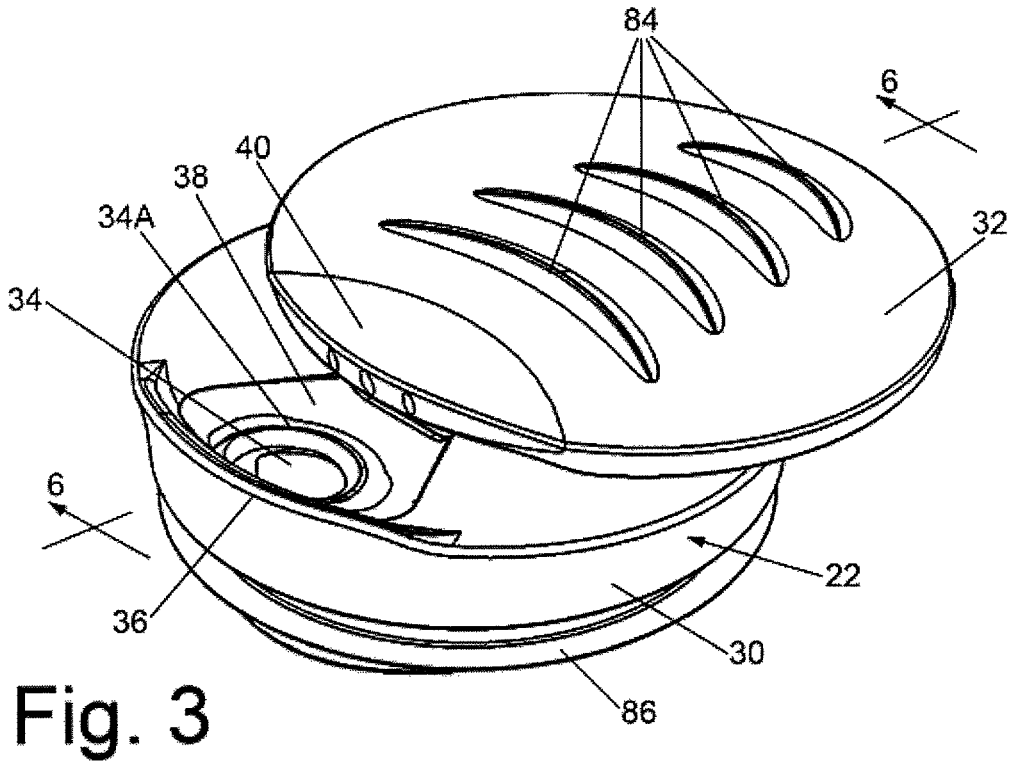
FIG. 3 is an isometric view similar to FIG. 1, but showing the cover member of the lid assembly in the "open" position.
Figure 8:
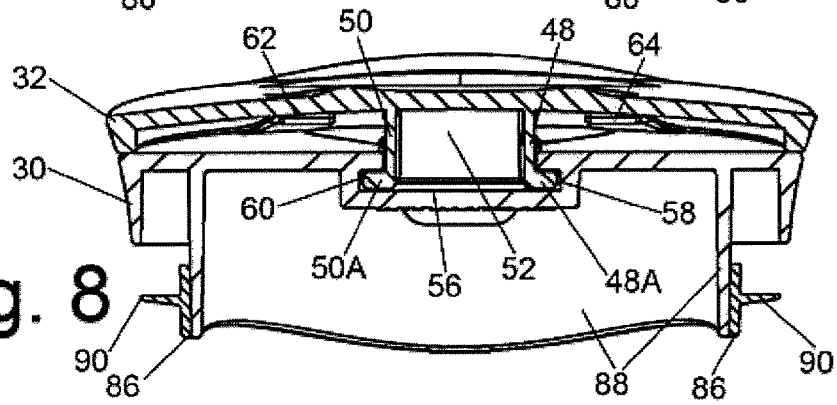
FIG. 8 is a sectional view of the closed lid assembly taking along line 8-8 in the direction of the arrow heads "8" in FIG. 2.
Figure 9:
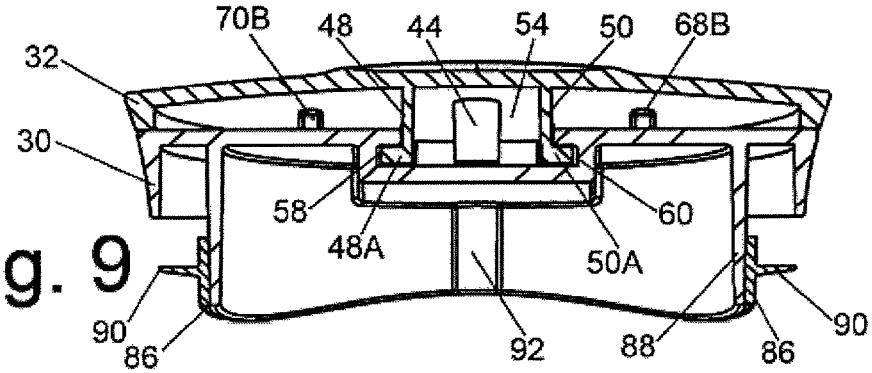
FIG. 9 is a sectional view of the closed lid assembly taking along line 9-9 in the direction of the arrow heads "9" in FIG. 2.

All containers making use of this invention will include a lid assembly that is comprised of a base member 30 (FIGS. 1-3 and 5) and a cover member 32 (FIGS. 1-4) slidably connected to the base member. The cover member 32 is arranged to be slid with respect to the base member from a closed position, such as shown in FIGS. 1, 2 and 9, to an open position, such as shown in FIGS. 3, 6 and 8, and vice versa. The lid assembly includes two detent mechanisms (to be described later). One of such mechanisms serves to hold the cover member in the closed position when desired and the other mechanism serves to hold the cover member in the open position when desired.

The base member 30 includes an opening 34 providing access to the interior of the inner vessel and through which the user of the container can drink its contents 26 when the cover member is in the open position. In order to facilitate the drinking of the beverage from the container 20 the base member 30 of the lid assembly 22 includes an upstanding edge or curb 36 located immediately in front of the opening 34. The curb is arranged to be disposed on the lower lip of the user when the user drinks from the container. The portion of the base member contiguous with the opening 34 thus defines what may be called the "beverage contact area", that is, the surface area of the base member that the beverage 26 makes contact with when the cover member is open and the user drinks from the opening.

In accordance with one preferred embodiment of this invention and in the interest of sanitation, the beverage contact area is in the form of a concave recess 38 surrounding the opening 34. The recess 38 serves to channel or direct any liquid (e.g., the beverage) which may be on the upper surface of the base member adjacent the opening 34 back into the opening and thus into the inner vessel 24B. This feature serves to prevent the formation of a location on the base member where bacteria or other contaminants could grow.

The cover member 32 is arranged when in its closed position to seal the opening 30. To that end, the cover member 32 includes an elastomeric body 40 (FIGS. 1, 4, 6 and 7) that forms the front portion of the cover member 32. The body 40 includes a portion 40A located on its underside which serves as a plug arranged to engage the periphery of the opening 34 and completely cover the opening 34 when the cover member is in the closed position. In accordance with one preferred embodiment of this invention the periphery 34A of the opening 34 includes a somewhat thickened or bulbous edge, which is arranged to be tightly engaged by the elastomeric plug 40A when the cover member is in the closed position. This action forms a fluid-tight interface between the opening and the plug, thereby preventing the accidental egress of the beverage 26 from the interior of the vessel 24B through the opening 34 when the cover member 32 is in the closed position.

As best seen in FIGS. 1, 5, 6 and 7, a port or vent 42 extends through the top wall of the base member. The vent serves to enable air to gain egress into the interior of the inner vessel 24B when the beverage is being drunk by the user to facilitate the drinking action. The cover member includes a tubular projection 44 extending down from its undersurface. An elastomeric plug 46 is located within the projection with the free end of the plug exposed. The projection 44 is located at a position on the undersurface of the cover member so that it is axially aligned with the vent 42 in the base member 30 when the cover member is in the closed position. Accordingly, when the cover member is in the closed position the free end of the plug 46 closes and seals the vent 42. This action prevents the beverage within the inner vessel 24B from exiting through the vent 42 when the cover member is closed. Accordingly, the action of the plug 46 in sealing and closing the vent 42 and the action of the plug 40A in sealing and closing the opening 34 when the cover member is closed renders the container 20 spill-proof.

Figure 4:
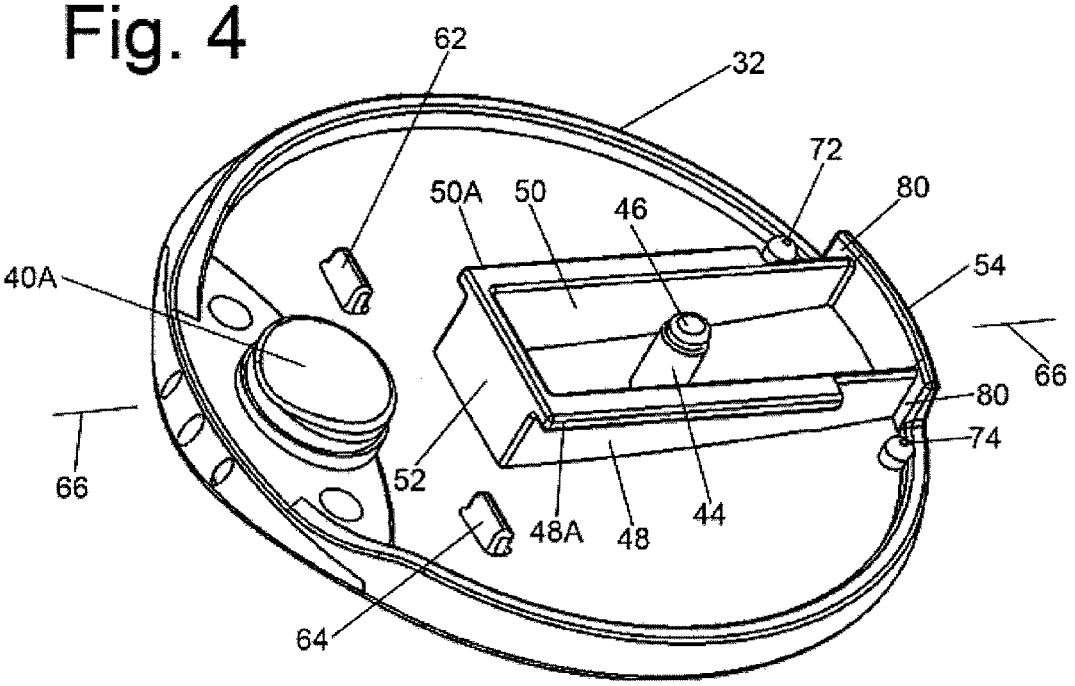
FIG. 4 is an isometric view of the underside of the cover member of the lid assembly shown in FIGS. 1-3.
Figure 5:
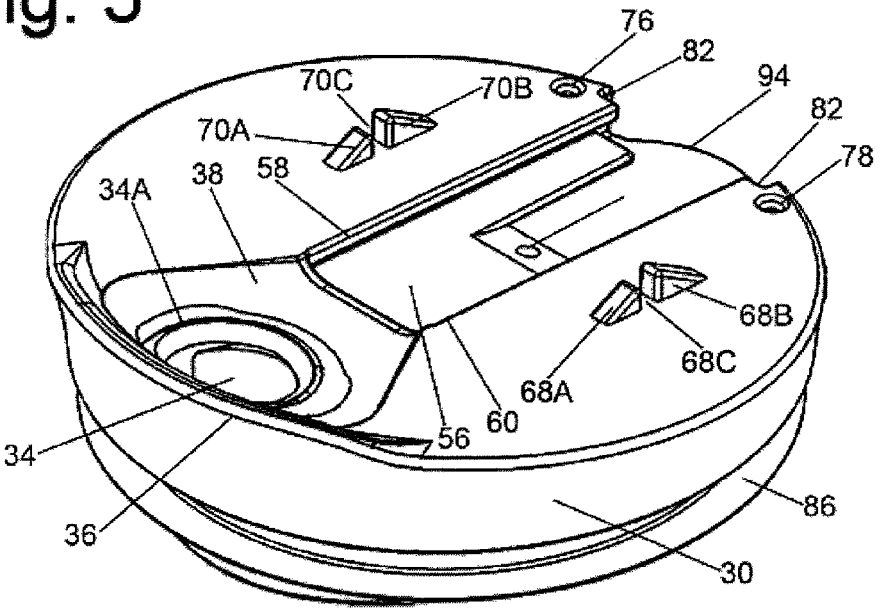
FIG. 5 is an isometric view of the base member of the lid assembly shown in FIGS. 1-3.
Figure 6:
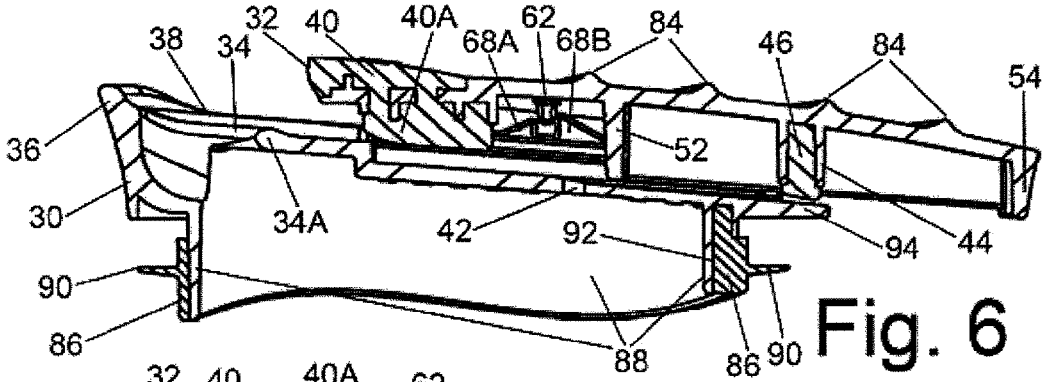
FIG. 6 is a longitudinal sectional view of the open lid assembly taken along line 6-6 in the direction of the arrow heads "6" in FIG. 3.

Turning now to FIGS. 4, 5, 8 and 9 the details of the structure that enables the cover member to be slid between its closed and open positions and vice versa will now be described. To that end, the underside of the cover member 32 includes a downwardly projecting box-like arrangement having a pair of longitudinally extending linear side walls 48 and 50, a front wall 52 and a rear wall 54. The side walls 48 and 50 each have a flanged lower edge. In particular, side wall 48 includes a flanged edge 48A and side wall 50 includes a flanged edge 50A. The edges 48A and 50A are arranged to be slidably located within correspondingly shaped grooves or tracks forming the side marginal edges of a channel 56 in the top surface of the base member 30 as best seen in FIG. 5. In particular, one longitudinal side 58 of the channel 56 is arranged to slidably receive the flanged edge 48A of the side wall 48, while the other longitudinal side 60 of the channel 56 is arranged to slidably receive the flanged edge 50A of the side wall 50. The front end of the channel 56 terminates at the concave recess 38, while the rear end of the channel is open, but is closed by the rear wall of the cover member when the cover member is in the closed position.

As mentioned earlier, in order to hold the cover member in either its closed position or its open position the lid assembly includes a pair of detent mechanisms. The detent mechanism for holding the cover member in the open position is best seen in FIGS. 4 and 5. In particular, as seen therein the cover member 32 includes a pair of fingers 62 and 64 projecting downward from the undersurface of the cover member. The fingers are axially aligned with each other along an axis perpendicular to the centerline 66 (FIG. 4) of the cover member. They are equidistantly spaced from that centerline and located slightly forward of the front wall 52. Each of the fingers is arranged to ride up and over a respective cam member forming a portion of the base member 32. In particular, the base member 32 includes a first pair of cam members 68A and 68B and a second pair of cam member 70A and 70B. All of the cam member are of a right triangular shape and have a ramped upper surface (the hypotenuse of the triangle). The cam members 68A and 68B are spaced from each other by a gap 68C. The cam members 70A and 70B are spaced from each other by a gap 70C.

Operation of the detent mechanism formed by the fingers 62 and 64 and the cam members 68A, 68B, 70A and 70B is as follows. When the cover member 32 is slid rearward, the fingers 62 and 64 ride up over the ramped upper surfaces of the cam members 68A and 68B, respectively, of the base member 30 until they reach the gaps, 68C and 70C, respectively, whereupon the free ends of the fingers drop into those gaps. Further rearward sliding of the cover member is precluded by the front surfaces of the cam members 68B and 70B, respectively, i.e., those cam members serve as stops. Moreover, the location of the fingers 62 and 64 within the gaps 68C and 70C, respectively, holds the cover member in the open position. When it is desired to close the cover member, all that is necessary is to apply a force to the cover member in the forward direction to cause the fingers 62 and 64 to leave the gaps 68C and 70C, respectively, and to slide down the ramped surfaces of the cam members 68A and 68B, thereby freeing the cover member.

The detent mechanism for holding the cover member in the closed position is also best seen in FIGS. 4 and 5. In particular, as seen therein the cover member 32 includes a pair of pins 72 and 74 projecting downward from the undersurface of the cover member. The fingers are aligned with each other along an axis perpendicular to the centerline 66. Moreover, they are equidistantly spaced from the centerline and located immediately forward of the rear wall 54. Each of the pins is arranged to be received within a respective recess in the base member 32. In particular, the base member 32 includes a recess 76 and a recess 78. Those recesses are located on either side of the channel 56 adjacent the rear end thereof. Each of the recesses is of a corresponding shape and size to receive a respective one of the pins. In particular, the recess 76 is arranged to receive the free end of the pin 72 and the recess 78 is arranged to receive the free end of the pin 74 when the cover member is in the open position.

Operation of the detent mechanism formed by the pins 72 and 74 and the recesses 76 and 78 will now be described. When the cover member is slid forward to close it the pins 72 and 74 ride over the top surface portions of the base member 30 that lead up to the recesses 76 and 78, respectively. When the pins reach those recesses, they drop into them. At this time further forward sliding of the cover member is precluded by peripheral portions 80 (FIG. 4) of the rear wall 54 of the cover member engaging the confronting rear surface 82 (FIG. 5) of the base member. Moreover, the location of the pins 72 and 74 within the recesses 76 and 78, respectively, holds the cover member in the open position. When it is desired to open the cover member, all that is necessary is to apply a force to the cover member in the rearward direction to cause the pins 72 and 74 to leave the recesses 76 and 78, respectively, and to slide over the portions of the top surface of the base member in front of those recesses, thereby freeing the cover member so that it can be slid to the open position.

In order to facilitate the sliding action of the cover member with respect to the base member, the cover member includes a plurality of arcuate ribs 84 projecting slightly upward from its top surface, as best seen in FIGS. 1-3.

Figure 7:
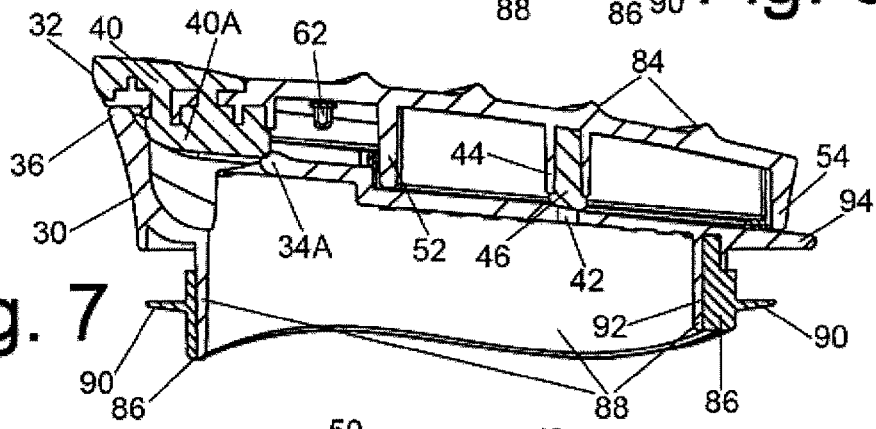
FIG. 7 is a longitudinal sectional view of the closed lid assembly taken along line 7-7 in the direction of the arrow heads "7" in FIG. 2.

The releasable securement of the lid assembly 22 to the container 20 is accomplished by means of an annular elastomeric ring 86 as best seen in FIGS. 1, 6 and 7. As can be seen therein the ring 86 is located, e.g., over-molded, on a circular cylindrical wall or skirt 88. The skirt 88 projects downward from the base member 32 and slightly inward radially from the periphery of the top surface of the base member. The ring 86 includes a radially outwardly projecting flange 90 which is arranged to tightly engage the inner surface of the inner vessel 24B adjacent the mouth of the vessel when the skirt 88 is introduced therein. The flange is flexible so that when the skirt 88 is inserted into the mouth of the inner vessel 24B, the flange 90 of the ring 86 flexes, as shown in FIG. 1, to form a good fluid-tight seal with the vessel wall, thereby releasably holding the lid assembly in place on the container. In order to ensure that the ring 86 is fixedly secured to the skirt 88 at the desired position, the skirt includes a vertical groove 92 in which an inner portion of the ring 86 resides (see FIGS. 1, 6 and 7).

As mentioned earlier the lid assembly is releasably secured to the container. Thus, the lid assembly can be readily removed from the container to fill and/or clean the container and/or clean the lid assembly. In order to facilitate the removal of the lid assembly from the container, the base member 32 of the lid assembly includes a tab 94 which projects outward from the rear end of the base member. The tab is arranged to be grasped by the user to pull the lid assembly from the container.

In accordance with one preferred embodiment of this invention the non-elastomeric portions of the lid assembly are formed from a solid rigid material, preferably plastic. Moreover, Shore hardness, color, and texture of the parts of the cover member and the base member may be uniform throughout or a combination thereof and selected using manufacturing materials known to skilled artisans. In the exemplary embodiment described above the annular ring 86 of the base member and the plug 40A and 46 are elastomeric. Alternatively, they can be any type of non-rigid material capable of forming a liquid-tight seal. Other embodiments have no such non-rigid structures or comprise different combination(s) of rigid versus non-rigid structures suitable for achieving the objectives of this invention. Moreover, the various components of the lid assembly may be formed using known molding methods and processes of forming plastic articles.

In some embodiments the rigid and non-rigid features of the lid are formed separately and connected together using means known by skilled artisans. In other embodiments, the rigid and non-rigid features of the lid are integrally formed or over molded. Different plastics can be used for forming the base member and the cover member. In some embodiments, composite thermoplastics, including thermoplastic polyolefin's (TPO) and thermoplastic vulcanizates (TPV) and combinations thereof may be effective in application. TPO refers to a polymer/filler blend comprising polypropylene, polyethylene, block copolymer polypropylene, rubber, and a reinforcing filler, which may include talc, fiberglass, carbon fiber, wollastonite, and Metal Oxy Sulfate. A nonexclusive listing of rubbers may include ethylenepropylene rubber (EPR), EP-diene rubber (EPDM), ethylene octene (EO), ethylene-butadiene (EB), and styrene-ethylene-butadiene-styrene (SEBS).

One particularly effective assembly may be formed from a thermoplastic olefin (TPO), with the rigid portions and parts thereof having a hardness of between about 55-65 Shore D and with the non-rigid parts and portions molded over their corresponding supportive structures and have a hardness of between about 65-70 Shore A.

It must be pointed out that specific embodiments have been described for the purposes of promoting an understanding of the principles of the invention. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates. In particular, the above described materials, compositions, and/or constituent elements forming the particular plastics discussed and their corresponding physical properties, should not be construed as limiting this invention. Thus, other materials, compositions, and/or constituent elements forming rigid and non-rigid materials or plastics possessing the physical properties useful in a manner as herein described may be appropriately desirable and availed using different materials, compositions, and/or constituent elements without undue experimentation and should be considered to fall within the scope of this invention, e.g., the lid, including its base and cover.

Without further elaboration the foregoing will so fully illustrate our invention that others may, by applying current or future knowledge, adopt the same for use under various conditions of service.

We claim:

1. A lid assembly for a beverage container having a beverage holding chamber defined by an interior wall having an interior surface, the beverage holding chamber being configured to hold a liquid beverage therein, said lid assembly comprising a base member and a cover member, said base member including a wall portion having an exterior surface configured to directly engage the interior surface of the interior wall of the container to releasably secure said lid assembly to the container, said base member having a periphery, an opening and contiguous portions, said opening being in fluid communication with the beverage holding chamber, said contiguous portions being contiguous with said opening, said cover member being slidably coupled to said base member to enable said cover member to be slid from a closed position to an open position and vice versa, said cover member being configured when slid to said closed position to isolate said opening and said contiguous portions of said base member from the ambient atmosphere, said cover member being configured when slid to said open position to have a portion thereof extending beyond said periphery of said base member and a portion thereof exposing said opening to enable a user of the container to drink the liquid beverage from said container via said opening, said cover member including an elastomeric member mounted thereon and moveable therewith, said elastomeric member being configured to engage said opening in said base member when said cover member is in said closed position to form a fluid tight seal at said opening.

2. The lid assembly of claim 1 wherein said exterior surface of said wall portion of said base member includes an annular seal for sealingly engaging the interior surface of the of the interior wall of the container.

3. The lid assembly of claim 1 wherein said base member comprises a concave recess surrounding said opening.

4. The lid assembly of claim 1 wherein said opening includes a periphery and wherein said periphery of said opening is thickened and is configured to be engaged by said elastomeric member to form a fluid tight seal at said opening when said cover member is in said closed position.

5. The lid assembly of claim 1 wherein said base member includes a vent hole and wherein said cover member comprises a plug member configured to close off and seal said vent hole when said cover member is in said closed position.

6. The lid assembly of claim 1 additionally comprising a detent member for holding said cover member in said closed position.

7. The lid assembly of claim 1 additionally comprising a detent member for holding said cover member in said open position.

8. The lid assembly of claim 6 additionally comprising a detent member for holding said cover member in said open position.

9. The lid assembly of claim 3 wherein said base member includes an upwardly extending curb located adjacent a portion of said opening, said curb including a front slope, a top portion and a back slope that progresses toward said opening, said recess defining a contact area from which the user may drink the beverage from the container.

10. The lid assembly of claim 1 wherein said base member includes a channel having a pair of grooves on opposite sides thereof and wherein said cover member includes a pair of projections, each of said projections having a portion configured to be slidably received in a corresponding one of said a pair of grooves to enable said cover member to be slid along said channel between said open and said closed positions and vice versa.

11. A beverage container comprising a hollow vessel and a lid assembly, said hollow vessel having an interior wall defining a beverage holding chamber for holding a liquid beverage therein, said chamber having an interior wall surface, said lid assembly comprising a base member and a cover member, said base member including a wall portion having an exterior surface configured to directly engage said interior wall surface to releasably secure said lid assembly to said vessel, said base member having a periphery, an opening and contiguous portions, said opening being in fluid communication with said beverage holding chamber, said contiguous portions being contiguous with said opening, said cover member being slidably coupled to said base member to enable said cover member to be slid from a closed position to an open position and vice versa, said cover member being configured when slid to said closed position to isolate said opening and the contiguous portions of said base member from the ambient atmosphere, said cover member being configured when slid to said open position to have a portion thereof extending beyond said periphery of said base member and a portion thereof exposing said opening to enable a user of the container to drink the beverage from said container via said opening, said cover including an elastomeric member mounted thereon and moveable therewith, said elastomeric member being configured to engage said opening in said base member when said cover member is in said closed position to form a fluid tight seal at said opening.

12. The beverage container of claim 11 wherein said exterior surface of said wall portion of said base member includes an annular seal for sealingly engaging said interior wall surface of said vessel.

13. The beverage container of claim 11 wherein said base member comprises a concave recess surrounding said opening.

14. The beverage container of claim 11 wherein said opening includes a periphery and wherein said periphery of said opening includes a thickened edge configured to be engaged by said elastomeric member to form said fluid tight seal at said opening when said cover member is in said closed position.

15. The beverage container of claim 11 wherein said base member includes a vent hole and wherein said cover member comprises a plug member configured to close off and seal said vent hole when said cover member is in said closed position.

16. The beverage container of claim 11 additionally comprising a detent member for holding said cover member in said closed position.

17. The beverage container of claim 11 additionally comprising a detent member for holding said cover member in said open position.

18. The beverage container of claim 16 additionally comprising a detent member for holding said cover member in said open position.

19. The beverage container of claim 13 wherein said base member includes an upwardly extending curb located adjacent a portion of said opening, said curb including a front slope, a top portion and a back slope that progresses toward said opening, said recess defining a contact area from which the user may drink the beverage from the container.

20. The beverage container of claim 11 wherein said base member includes a channel having a pair of grooves on opposite sides thereof and wherein said cover member includes a pair of projections, each of said projections having a portion configured to be slidably received in a corresponding one of said a pair of grooves to enable said cover member to be slid along said channel between said open and said closed positions and vice versa.

* * * * *